United States Patent [19]

White

[11] 4,183,531

[45] Jan. 15, 1980

[54] FOOTBALL GAME DEVICE

[76] Inventor: Gerald D. White, 2125 Collier Dr., Florissant, Mo. 63031

[21] Appl. No.: 801,469

[22] Filed: May 31, 1977

[51] Int. Cl.[2] ..... A63F 7/06

[52] U.S. Cl. ..... 273/94 R; 273/106 R

[58] Field of Search ..... 273/85 R, 94 R, 95, 273/106 R, 106 B, 128 R, 108, 100; 206/104, 105, 106

[56] References Cited

U.S. PATENT DOCUMENTS

| | | | |
|---|---|---|---|
| 483,166 | 9/1892 | Posey | 206/104 |
| 1,145,955 | 7/1915 | Wittstein | 273/94 R |
| 1,280,082 | 9/1918 | Pierson | 273/94 R |
| 1,339,975 | 5/1920 | Pfersch | 206/104 X |
| 1,603,717 | 10/1926 | Robind et al. | 273/94 R |
| 1,663,404 | 3/1928 | Hands | 273/94 R |
| 2,006,678 | 7/1935 | Kappler | 206/104 |

FOREIGN PATENT DOCUMENTS

| | | | |
|---|---|---|---|
| 422851 | 12/1925 | Fed. Rep. of Germany | 273/106 B |
| 420173 | 11/1934 | United Kingdom | 206/105 |

*Primary Examiner*—Paul E. Shapiro

[57] ABSTRACT

The present invention relates to a new and improved football game comprising, a playing board with appropriate football field indicia, goal post means mounted on said board, ball means formed in the shape of a conventional match book cover or a partially flattened band and a marker means.

2 Claims, 3 Drawing Figures

7

6

8
9
1
5
4
11
10
3
3
2

FOOTBALL GAME DEVICE

BACKGROUND OF THE INVENTION

Conventional techniques and games providing the aura of football and field goals are of interest as a result of the heavy emphasis placed upon the game of football. Conventional games involve the use of conventionally shaped devices and objects which require little experience before maximum skill is attained thus causing their interest span to be relatively short.

SUMMARY

The present invention contemplates utilizing a non-conventionally shaped "football" to be used in the game which requires more skill than usually thus lengthening its interest span and yet forgives a lack of skill sufficiently to make the game interesting and enjoyable.

It is therefore an object of the present invention to provide a football game device and football which provides a challenge with respect to skill and also forgives a lack of skill sufficiently to allow interest and enjoyment to remain.

A further object of the present invention is to provide such a device which is comprised of a playing board provided with football field indicia thereon, goal posts mounted thereon, a football shaped in the form of a conventional match book or partially flattened paper band and a marker device.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figures 1, 2, 3:
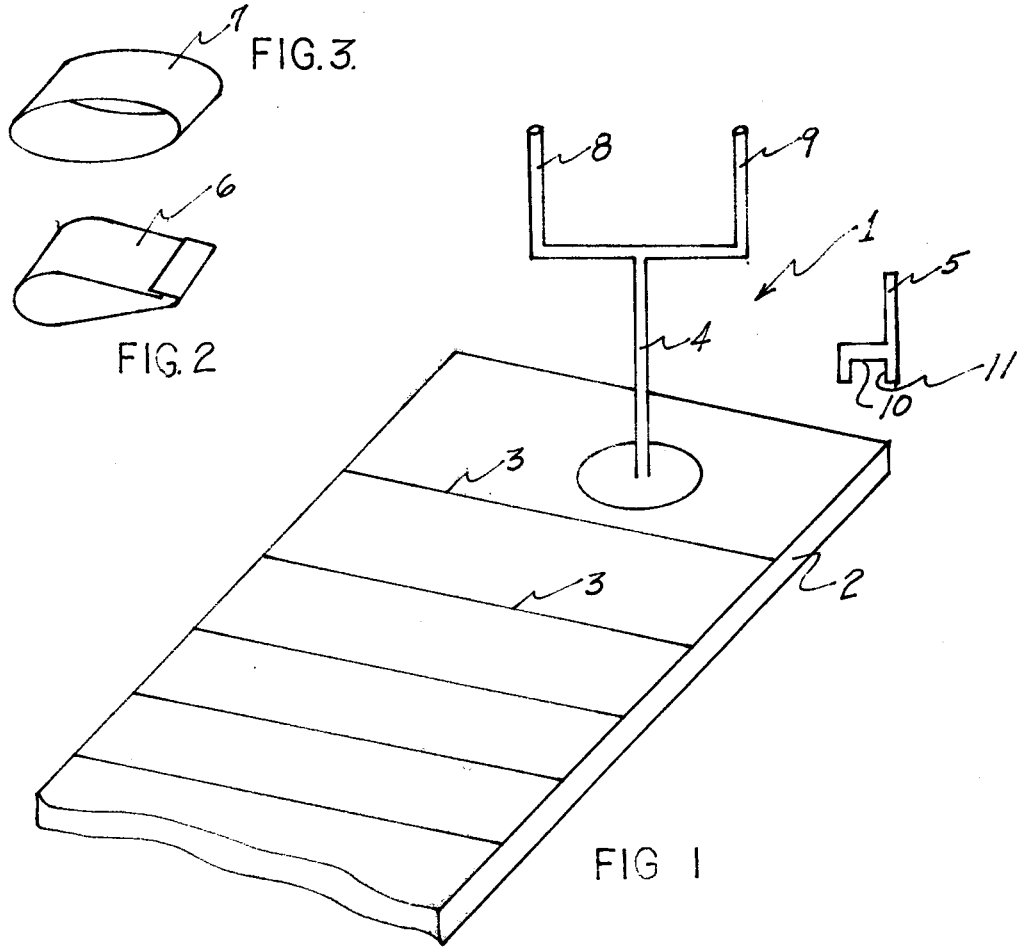
FIG. 1 is a perspective view of a portion of the football field goal device constructed in accordance with and embodying the present invention.
FIG. 2 is a perspective view of a football used with the device in FIG. 1.
FIG. 3 is a perspective view of another football used with the device in FIG. 1.

Referring now in more detail and by reference characters to the drawings which illustrate practical embodiments of the present invention, FIG. 1, and FIG. 2, are perspective views of a football game device, 1, constructed in accordance with, used in and embodying the present invention.

As shown in FIG. 1, and FIG. 2, device, 1, comprises playing board, 2, provided with football field indicia, 3, marked thereon, goal post means, 4, mounted on board, 2, marker means, 5, and football, or projectile means, 6, in the shape of a conventional match book cover. An alternate football, 7, is shown in FIG. 3.

Typically, the footballs would be constructed of materials as cardboard or the like and would be sized of the order of a conventional match book cover.

A typical method of playing the game or the rules regulating the game are as follows: A touchdown is 6 points, a kick after is 1 point, a field goal is 3 points, a safety is 2 points, a game winner is an automatic 21 points. The object of the game is to be the first person to obtain 21 points or more.

To score a touchdown the following must happen; the ball, 6, is placed in a designated area which would typically be the area short of a particular yard line, such as the 20 yard line or 40 yard line, and would be varied dependent upon the age and skill of the players, then it is hit, pushed or flipped across the playing field, 2, and must stop in a touchdown area designated on board, 2 which would typically be the end zone. The force impelling the ball, 6, is from the finger of the player. If the ball passes over the end of the board, 2, the opponent places the ball, 6, in his designated area and trys for a touchdown. If a player scores a touchdown then he is entitled to try for an extra point from a designated spot on the board, 2. The player then attempts to impel the ball, 6, between the uprights, 8, and, 9. If the ball comes up short of the touchdown area or end zone when attempting a touchdown an opponent may play from that spot and attempt a touchdown, field goal, or safety. A safety is obtained by trying for a touchdown and coming up a "little short". A "little short" is determined by marker, 5. If the ball is completely within a distance equal to the width of space, 10, on marker, 5, of the touchdown area or goal line, then safety is scored. Following a safety the scorer may try for another safety or a touchdown. A "game winner" is obtained by causing the ball, 6, to land in an area marked on the field, 2. Other provisions may be made for balls travelling out of bounds, etc. Time limits may be placed upon the players taking their turns.

Considerable skill is required using a ball, 6, as contemplated herein in order to cause them to travel a desired distance as well as to cause them to fly, sail or soar so that it can be caused to pass between uprights, 8, and, 9.

It should be understood that changes and modifications in the form, construction, arrangement, and combination of the football game device and methods of making and using the same may be made and substituted for those herein shown and described without departing from the nature and principle of my invention.

Having thus described my invention, what I claim is new and desire to secure by United States Letters Patent is:

1. A football game device comprising, a playing board provided with football field indicia marked thereon including yard lines and goal lines, a goal post operably mounted on said board, marking means, for football position measurement and a projectile, said projectile in the form of a partially flattened band.

2. A football game device comprising, a playing board provided with football field indicia marked thereon including yard lines and goal lines, a goal post operably mounted on said board, marking means, for football position measurement, said marking means comprising a pair of elongated members disposed in approximate parallel relationship to each other and joined together by a third member spanning the space between said members and attached to each such member, and a projectile, said projectile in the form of a partially flattened band.

* * * * *